US008896196B2

(12) United States Patent
Zhou et al.

(10) Patent No.: US 8,896,196 B2
(45) Date of Patent: Nov. 25, 2014

(54) FIELD EMITTING FLAT LIGHT SOURCE AND METHOD FOR MAKING THE SAME

(75) Inventors: Mingjie Zhou, Guangdong (CN); Wenbo Ma, Guangdong (CN); Pengrui Shao, Guangdong (CN)

(73) Assignee: Ocean's King Lighting Science & Technology Co., Ltd., Guangdong (CN)

( * ) Notice: Subject to any disclaimer, the term of this patent is extended or adjusted under 35 U.S.C. 154(b) by 91 days.

(21) Appl. No.: 13/811,867

(22) PCT Filed: Aug. 17, 2010

(86) PCT No.: PCT/CN2010/076046

§ 371 (c)(1), (2), (4) Date: Jan. 23, 2013

(87) PCT Pub. No.: WO2012/022023

PCT Pub. Date: Feb. 23, 2012

(65) Prior Publication Data

US 2013/0119856 A1 May 16, 2013

(51) Int. Cl.

| | |
|---|---|
| ***H01J 63/04*** | (2006.01) |
| ***H01J 9/02*** | (2006.01) |
| ***H01J 31/12*** | (2006.01) |
| ***H01J 63/02*** | (2006.01) |
| ***H01J 63/06*** | (2006.01) |

(52) U.S. Cl.

CPC ..... *H01J 63/04* (2013.01); *H01J 31/127* (2013.01); *H01J 63/02* (2013.01); *H01J 63/06* (2013.01); *H01J 9/025* (2013.01)

USPC ..... 313/497; 313/309; 313/292; 445/33

(58) Field of Classification Search

CPC ..... H01J 63/04

USPC ..... 313/496–497

See application file for complete search history.

(56) References Cited

U.S. PATENT DOCUMENTS

2004/0147049 A1 7/2004 Lee et al.

(Continued)

FOREIGN PATENT DOCUMENTS

JP 2003-59431 A 2/2003

(Continued)

OTHER PUBLICATIONS

Communication From the Japanese Patent Office Regarding a Counter-Part Foreign Application Dated H26-01-06 Which Converts to Jan. 6, 2014.

(Continued)

*Primary Examiner* — Elmito Breval

(74) *Attorney, Agent, or Firm* — Rosenberg, Klein & Lee

(57) ABSTRACT

A field emission flat light source and a manufacturing method thereof are provided. The field emission flat light source includes an anode (110), a cathode (120), a light guide plate (130) and a separation body (140). The anode (110) and the light guide plate (130) are separated by the separation body (140). The cathode (120) is provided in the contained space (150) formed by the anode (110), the light guide plate (130) and the separation body (140). The anode (110) includes an anode substrate (112), a metal reflective layer (114) provided on the anode substrate (112) and a light emitting layer (116) provided on the metal reflective layer (114). The cathode (120) includes a cathode substrate (122) and an electron emitter (124) provided on the surface of the cathode substrate (122). The thermal conductivity of the field emission flat light source is improved. The field emission flat light source is applied to the field of the liquid crystal display or the illumination light.

7 Claims, 2 Drawing Sheets

(56) References Cited

U.S. PATENT DOCUMENTS

| | | | | |
|---|---|---|---|---|
| 2005/0179363 | A1* | 8/2005 | Choi et al. | 313/497 |
| 2006/0261726 | A1 | 11/2006 | Choi et al. | |
| 2008/0252195 | A1 | 10/2008 | Liu et al. | |
| 2009/0068411 | A1 | 3/2009 | Hong et al. | |

FOREIGN PATENT DOCUMENTS

| | | | |
|---|---|---|---|
| JP | 2006-332044 | A | 12/2006 |
| JP | 2008-262913 | A | 10/2008 |
| JP | 2008-288156 | A | 11/2008 |

OTHER PUBLICATIONS

Wu, et al.; "Field emission properties of α-Fe2O3 nanotips prepared on indium tin oxide coated glass by thermal oxidation of iron film"; Journal of Vacuum Science & Technology B: Microelectronics and Nanometer Structures (vol. 28 , Issue: 2), Mar. 2010, pp. C2B34-C2B37.

Communication From the European Patent Office Regarding a Counter-Part Foreign Application Dated Jan. 3, 2014.

Communication from the Japanese Patent Office regarding a counterpart foreign application dated (Emperor Year H26) Jul. 28, 2014.

* cited by examiner

FIELD EMITTING FLAT LIGHT SOURCE AND METHOD FOR MAKING THE SAME

FIELD OF THE INVENTION

The present disclosure relates to light sources, and more particularly relates to a reflective field emitting flat light source and a method for making the same.

BACKGROUND OF THE INVENTION

The field emission flat light source can be widely used in various illumination fields, owing to the advantages of the former, such as energy-saving, environmental protection, and being able to work in harsh environments (such as high and low temperature environment), the thin, etc. Comparing with the conventional back light module, the field emission flat light source has not only a simple structure, but also a power saving feature, a small size, easy to be large-area flatted, high brightness, thus satisfying the requirements for the future development needs of the flat light source. While the field emission flat light source has irreplaceable advantages in the future of competition in the market, however, there are still some problems to be solved in the practical application.

When the conventional field emission flat light source is applied to the back light module for a liquid crystal display, the anode emitting layer of the field emission light source is close to the liquid crystal panel and is sandwiched between the cathode and the liquid crystal panel. After a long term of bombardment of the anode from the electron emitted from the cathode, the temperature will raise. If the heat is difficult to be dissipated by radiation, the serving life of the liquid crystal panel will be affected, and it may also cause the thermal deformation, even rupture of the anode. In addition, the heat dissipation problem still needs to be solved even not applied to the back light module, because the glass substrate, which is often used as anode, has a relatively poor heat dissipation characteristic. Furthermore, since the anode serves as the light incidence surface, it is difficult to assemble metal heat sink device on the surface of the anode.

SUMMARY OF THE INVENTION

In one aspect of the present disclosure, it is necessary to provide a field emission flat light source having a better heat dissipation performance and a method for making the same.

A field emission flat light source includes: an anode, a cathode, a light-transmittable panel, and a isolater, the anode and the light-transmittable panel are in a flat plate shape, the anode is parallel to the cathode; wherein the anode and the light-transmittable panel is separated by the isolater; the anode, the light-transmittable panel, and the isolater cooperatively forms a vacuum confined space, the cathode is suspended in the vacuum confined space; the anode comprises an anode substrate, a metal reflective layer positioned on the anode substrate, and an emitting layer positioned on the metal reflective layer; the cathode comprises a plurality of cathode substrates which are separately disposed and electron emitter formed on surfaces thereof.

Preferably, the cathode substrates are parallel metal wires or the cathode substrates form a network composed of metal wires.

Preferably, the electron emitter has a structure type of film, quasi-one-dimensional, and cone, or a composition structure composed of type of film, quasi-one-dimensional, and cone; the electron emitter is selected from the group consisting of diamond film, carbon nanotubes, carbon nanotube walls, copper oxide nanowires, zinc oxide nanowires, zinc oxide nanorods, four-angle-shaped nano zinc oxide, and iron oxide nanowires.

Preferably, the anode substrate is glass or ceramic; the emitting layer is phosphor, light-emitting film or luminescent glass.

Preferably, the anode further comprises an opaque anode electrode sandwiched between the anode substrate and the metal reflective layer.

Preferably, the opaque anode electrode is Cr, Mo or Al electrode.

Preferably, the anode further comprises a transparent anode electrode sandwiched between the anode substrate and the metal reflective layer or between the metal reflective layer and the emitting layer.

Preferably, the transparent anode electrode is ITO transparent electrode.

A method for making the field emission flat light source includes the following steps:

making an anode: depositing a metal reflective layer on a anode substrate using vapor plating, electroplating or sputtering method, then preparing an emitting layer on the metal reflective layer using coating or magnetron sputtering method; making a cathode: preparing electron emitter on a cathode substrate using spraying or direct growth method; and assembling the field emission flat light source: firstly, placing the obtained anode on a horizontal operation table, securing a isolater on peripheral of the anode, securing the cathode on the isolater, leading out the electrode and ensuring that the cathode and anode are in parallel; then pressing the light-transmittable panel to the isolater, securing and sealing; finally sealing and vacuum pumping the assembled the field emission flat light source through an exhaust pipe.

Preferably, the method further includes: depositing a transparent or opaque anode electrode on the anode substrate using magnetron sputtering or vapor plating method, or depositing a transparent anode electrode on the metal reflective layer.

Since the metal reflective layer is introduced and the cathode is arranged between the anode and the light-transmittable panel, the emitting layer is kept a distance away from the light-transmittable panel, therefore when the described field emission flat light source is applied to the back light module, it can avoid the issues such as the service life of the liquid crystal panel caused by emitting layer being too close to the liquid crystal panel of the display. In addition, the metal reflective layer 114 is made of metal having good heat dissipation ability, thus increasing the stability and the service life of the field emission flat light source.

The cathode substrates are parallel metal wires or the cathode substrates form a network composed of metal wires, and electron emitters are coated on the cathode substrates, such arrangement is in favor of the distribution between the electron emitters, increasing the distance between the tips of the electron emitters, thus increasing the number of the electron emitters which can effectively release the electrons, and a light source with high emission efficiency and stability is obtained.

DETAILED DESCRIPTION

The disclosure is illustrated by way of example and not by way of limitation in the figures of the accompanying drawings in which like references indicate similar elements.

Figure 1:
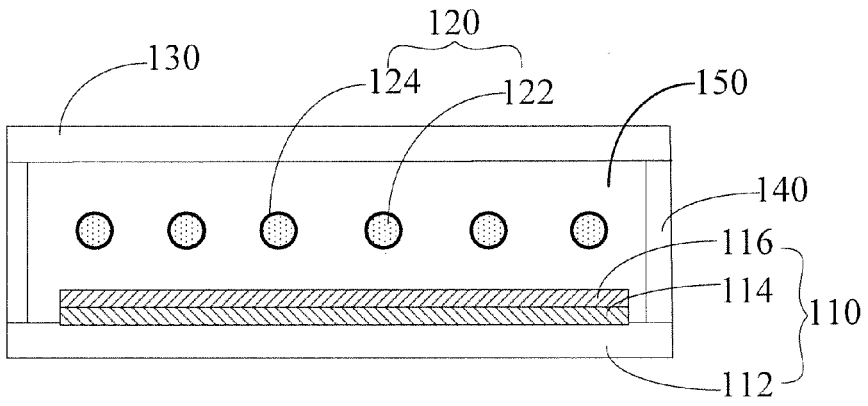
FIG. 1 is a front, cross-section view of a field emission flat light source according to an embodiment of the present disclosure.
Figure 2:
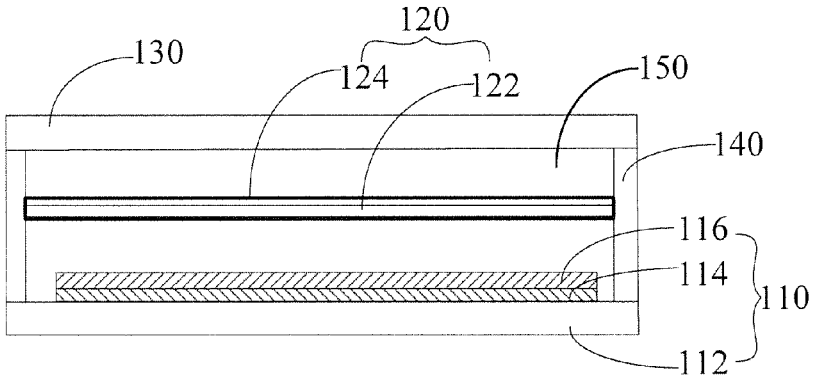
FIG. 2 is a side, cross-section view of the field emission flat light source of FIG. 1.

Referring to FIG. 1 and FIG. 2, an embodiment of a field emission flat light source, which is substantially rectangular, includes an anode 110, a cathode 120, a light-transmittable panel 130, and a plurality of isolaters 140.

The anode 110 includes an anode substrate 112 having a flat plate shape, a metal reflective layer 114 positioned on the anode substrate 112, and an emitting layer 116 positioned on the metal reflective layer 114. The anode 110 is parallel to the cathode 120. The light-transmittable panel 130 is shaped as a flat plate and positioned oppose to the anode 110. The plurality of isolaters 140 are positioned between the anode 110 and the light-transmittable panel 130. The anode 110, the light-transmittable panel 130, and the plurality of isolaters 140 cooperatively forms a vacuum confined space 150. The cathode 120 is positioned and suspended in the vacuum confined space 150. The cathode 120 includes a plurality of cathode substrates 122, which are separately disposed. Each cathode substrate 122 has two ends secured on the opposite isolaters 140, respectively. The surface of the cathode substrate 122 is coated with electron emitter 124.

The anode 110 and the cathode 120 are connected to a power source (not shown) via wires. When the power is turned on, the electron emitter 124 on the surface of the cathode substrate 122 releases electrons due to the applied electric field, and the emitting layer 116, which is subjected to the accelerated electrons released from the cathode, starts to illuminate. The fluorescence emitted by the emitting layer 116 goes through the gap between the plurality of the cathode substrates 122 and emits through the light-transmittable panel 130. Due to the metal reflective layer 114 formed on the anode substrate 112, part of the fluorescence emitted by the emitting layer 116 will be reflected upwardly by the metal reflective layer 114, thus largely enhancing the luminous intensity and luminous efficiency of the field emission flat light source.

Since the metal reflective layer 114 is introduced and the cathode 120 is arranged between the anode 110 and the light-transmittable panel 130, the emitting layer 116 is kept a distance away from the light-transmittable panel 130, therefore when the described field emission flat light source is applied to the back light module, it can avoid the issues such as the short service life of the liquid crystal panel caused by emitting layer 116 being too close to the liquid crystal panel of the display. In addition, the metal reflective layer 114 is made of metal having good heat dissipation ability, thus increasing the stability and the service life of the field emission flat light source.

In the illustrate embodiment, the cathode substrates 122 are composed of parallel metal wires suspended in the vacuum confined space 150, and a plane defined by the cathode substrates 122 is parallel to the plane where the anode substrate 112 located. The surface of the cathode substrates 122 is disposed of the electron emitter 124 made of diamond film.

In the illustrate embodiment, the cathode substrates 122 is made of glass. The metal reflective layer 114 is made of aluminum, which has a high reflection rate. The emitting layer 116 is made of luminescent glass having a substantially flat plate shape.

Figure 3:
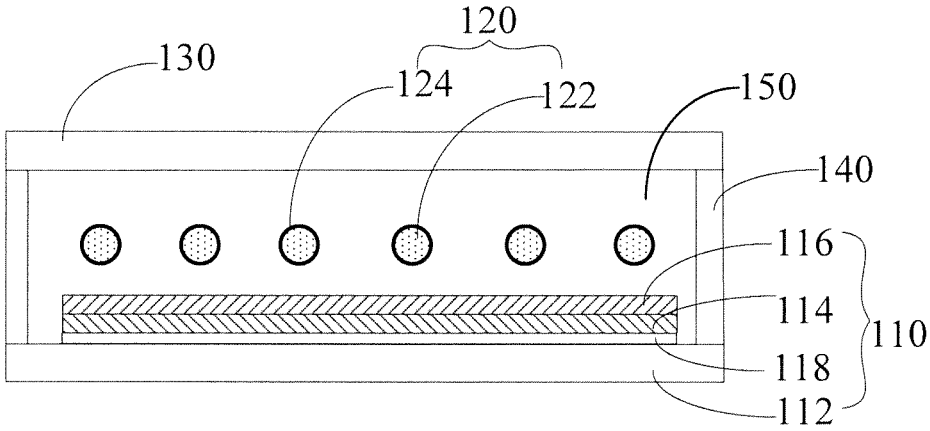
FIG. 3 is a front, cross-section view of a field emission flat light source according to another embodiment of the present disclosure.

Referring to FIG. 3, in an alternative embodiment, the anode 110 of the field emission flat light source further includes an anode electrode 118. The anode electrode 118 is made of opaque metal and is sandwiched between the metal reflective layer 114 and the anode substrate 112.

In addition, the anode electrode 118 may also be transparent, as long as it is sandwiched between the metal reflective layer 114 and the emitting layer 116, or between the metal reflective layer 114 and the anode substrate 112, as shown in FIG. 3.

In alternative embodiment, the cathode substrates 122 form a network composed of metal wires. Preferably, the surface of the metal wire is coated with electron emitter 124. The electron emitter 124 may have a structure type of film, quasi-one-dimensional, and cone, or a composition structure composed of type of film, quasi-one-dimensional, and cone. Furthermore, the electron emitter 124 may be made of other materials, such as carbon materials, e.g. carbon nanotubes, carbon nanotube walls, or copper oxide nanowires, or oxide materials, e.g. zinc oxide nanowires, zinc oxide nanorods, four-angle-shaped nano zinc oxide, or iron oxide nanowires.

Moreover, in alternative embodiment, the cathode substrates 122 may be made of glass or ceramic. The emitting layer 116 may be phosphor or a light-emitting film coated on the surface of the metal reflective layer 114. Besides, the anode electrode 118 may be a metal electrode or non-metallic electrode, such as opaque Cr, Mo or Al electrode, or transparent ITO electrode.

An embodiment of a method for making the field emission flat light source as shown in FIG. 3 will be described in greater details.

Step one, preparing an anode. An anode electrode 118 is deposited on an anode substrate 112 using magnetron sputtering or vapor plating method, a metal reflective layer 114 is then prepared on a surface of the anode electrode 118. The metal reflective layer 114 may be prepared using vapor plating, electroplating or sputtering method. Then an emitting layer 116, which may be whiter phosphor or color phosphor, is prepared on the metal reflective layer 114, such that whiter or color light will be emitted when the electron bombard the phosphor. When the emitting layer 116 is a powder type, it can be prepared by coating; when the emitting layer 116 is a light-emitting film, it can be prepared using magnetron sputtering method.

Step two, preparing a cathode 120. The cathode 120 includes cathode substrates 122 and electron emitter 124. The cathode substrates 122 are parallel metal wires or the cathode substrates 122 form a network composed of metal wires. The electron emitter 124 may be one-dimensional nanomaterial or a film-type material. The electron emitter 124 may be prepared using spraying or direct growth method. For example, a carbon nanotube electron emitter 124 is sprayed on the cathode substrates 122.

Step three, assembling the field emission flat light source. Firstly, the obtained anode 110 is placed on a horizontal operation table, isolaters 140 are placed on peripheral of the anode 110, secured using low glass powder. Then the cathode 120 is secured on the isolaters 140, out the electrode are led out. The cathode 120 and anode 110 are ensured in parallel. Then the light-transmittable panel 130 is pressed to the isolaters 140, secured and sealed. Finally, the assembled the field emission flat light source is sealed and vacuum pumped through an exhaust pipe.

The above the field emission flat light source and the making method will further be described below with reference to specific examples.

EXAMPLE 1

In this example, ITO glass having a thickness of 4 mm was used as an anode substrate. The anode substrate was ultrasonic cleaned successively with acetone, ethanol, deionized water for 15 min, then blow-dried or dried. A reflective aluminum layer having a thickness of about 2 μm was vapor plated on the ITO glass, followed by screen printing a white-light phosphor layer having a thickness of about 35 μm on the surface of the reflective aluminum layer. Nickel wires were used as cathode substrate, and since the nickel wire could serve as the catalyst for directly growing of the carbon nanotubes, the carbon nanotube was used as electron emitter. The nickel wires were placed in a middle portion of a quartz tube, and then the sample was subjected to surface treatment by introducing hydrogen for 1 hour under the protection of argon at a temperature of 650° C. The temperature was raised to the growth temperature and a mixture gas containing acetylene or methane was introduced for 5 to 20 minutes. Finally the sample was cooled to room temperature under the protection of argon and carbon nanotube electron emitter was obtained. After the preparation of the cathode, the device was assembled according to the method described above, and then it was placed on an exhaust platform and the space was vacuum pumped and sealed off until the vacuum is less than $10^{-4}$ Pa.

EXAMPLE 2

In this example, ceramic plate having a thickness of 4 mm was used as an anode substrate. The ceramic plate was ultrasonic cleaned successively with acetone, ethanol, deionized water for 15 min, then blow-dried or dried. A chromium electrode having a thickness of about 300 m was deposited on the ceramic plate using magnetron sputtering. A reflective aluminum layer having a thickness of about 1 μm was vapor plated on the ceramic substrate with chromium electrode, followed by screen printing a white-light phosphor layer having a thickness of about 35 μm on the surface of the reflective aluminum layer. Copper oxide nanowires were used as cathode substrate. The copper powder slurry was brushed on a surface of the conductive ITO layer, and then sintered at a temperature of 400° C. in air for 3 hours to directly grow the copper oxide nanowires on the surface of the cathode substrate. After the preparation of the cathode, the device was assembled according to the method described above, and then it was placed on an exhaust platform and the space was vacuum pumped and sealed off until the vacuum is less than $10^{-4}$ Pa.

Field emission light source having the above structure is excellent in heat dissipation, thus it can be widely applied to illumination source or liquid crystal display and other fields. In addition, the described making method is simple and easy for application.

Although the invention has been described in language specific to structural features and/or methodological acts, it is to be understood that the invention defined in the appended claims is not necessarily limited to the specific features or acts described. Rather, the specific features and acts are disclosed as sample forms of implementing the claimed invention.

What is claimed is:

1. A field emission flat light source, comprising:

an anode member, a cathode member, a light-transmittable panel, and a isolater, wherein the anode member and the light-transmittable panel are in a flat plate shape, wherein the anode member is disposed in a spaced apart relationship with said light-transmittable panel and in a parallel relationship with the cathode member, and wherein the anode member and the light-transmittable panel is separated by the isolater;

wherein the anode member, the light-transmittable panel, and the isolater cooperatively form a vacuum confined space, the cathode member being suspended in the vacuum confined space;

wherein the anode member comprises an anode substrate, a metal reflective layer positioned above the anode substrate, an emitting layer positioned above the metal reflective layer, and a substantially singe anode electrode formed of a material selected from a group including Cr, Mo, and ITO, and positioned in a predetermined relationship with said metal reflective layer and in a spaced apart relationship with said light-transmittable panel; and wherein the cathode member comprises a plurality of cathode substrates which are separately disposed, and an electron emitter formed on surfaces of said cathode substrates.

2. The field emission flat light source according to claim 1, wherein the cathode substrates are formed as parallel metal wires, or wherein the cathode substrates form a network composed of metal wires.

3. The field emission flat light source according to claim 1, wherein the electron emitter has a structure type of film, quasi-one-dimensional and cone, or a composition structure composed of type of film, quasi-one-dimensional and cone; and wherein the electron emitter is selected from the group consisting of diamond film, copper oxide nanowires, zinc oxide nanowires, zinc oxide nanorods, four-angle-shaped nano zinc oxide, and iron oxide nanowires.

4. The field emission flat light source according to claim 1, wherein the anode substrate is formed from glass or ceramic; and wherein the emitting layer is formed from phosphor, light-emitting film or luminescent glass.

5. The field emission flat light source according to claim 1, wherein said substantially single anode electrode of the anode member is an opaque anode electrode sandwiched between the anode substrate and the metal reflective layer.

6. The field emission flat light source according to claim 1, wherein said substantially single anode electrode of said anode member is a transparent anode electrode sandwiched between the anode substrate and the metal reflective layer or between the metal reflective layer and the emitting layer.

7. A method for making the field emission flat light source comprising the steps of:

forming an anode member by:

preparing an anode substrate;

forming a metal reflective layer and an anode electrode above said anode substrate using vapor plating, electroplating or sputtering method, wherein said anode electrode is a transparent or opaque substantially single anode electrode, wherein, when said substantially single anode electrode is opaque, it is formed from Cr or Mo materials and is sandwiched between said anode substrate and said metal reflective layer, and wherein, when said substantially single anode electrode is transparent, it is formed from an ITO material;

forming an emitting layer above the metal reflective layer using coating or magnetron sputtering method, wherein said transparent substantially single anode electrode is sandwiched between the anode substrate and said metal reflective layer or between said metal reflective layer and said emitting layer;

forming a cathode member by: preparing an electron emitter on a cathode substrate using spraying or direct growth method; and assembling the field emission flat light source by:

placing the anode member on a horizontal operation table, subsequently, securing an isolater on a periphery of the anode member, subsequently, securing the cathode member on the isolater in a parallel relationship with said anode member, leading out the electrodes;

subsequently, pressing, securing and sealing the light-transmittable panel to the isolater in spaced apart relationship to said anode member, and subsequently, sealing and vacuum pumping the assembled field emission flat light source through an exhaust pipe.

* * * * *